US006817946B2

(12) United States Patent
Motegi et al.

(10) Patent No.: US 6,817,946 B2
(45) Date of Patent: Nov. 16, 2004

(54) VIRTUAL IMAGE AND REAL IMAGE SUPERIMPOSED DISPLAY DEVICE, IMAGE DISPLAY CONTROL METHOD, AND IMAGE DISPLAY CONTROL PROGRAM

(75) Inventors: Satoshi Motegi, Tokyo (JP); Masatoshi Satoh, Tokyo (JP); Nobuyasu Tamura, Tokyo (JP); Kosaku Noda, Tokyo (JP); Misao Yamanaka, Tokyo (JP); Masanori Suganuma, Tokyo (JP); Hayato Mizue, Tokyo (JP)

(73) Assignee: Konami Corporation, Tokyo (JP)

( * ) Notice: Subject to any disclaimer, the term of this patent is extended or adjusted under 35 U.S.C. 154(b) by 82 days.

(21) Appl. No.: 10/137,631

(22) Filed: May 2, 2002

(65) Prior Publication Data

US 2003/0119577 A1 Jun. 26, 2003

(30) Foreign Application Priority Data

Dec. 21, 2001 (JP) ..... 2001-390348

(51) Int. Cl.[7] ..... A63F 9/24

(52) U.S. Cl. ..... 463/31; 463/20; 463/34; 273/138.1

(58) Field of Search ..... 463/16, 20–22, 463/30–34; 273/138.1, 139, 138.2, 143 R; 345/4–6

(56) References Cited

U.S. PATENT DOCUMENTS

| | | | | |
|---|---|---|---|---|
| 5,408,344 | A | 4/1995 | Takahashi et al. | |
| 5,464,216 | A * | 11/1995 | Hoshi et al. | 473/349 |
| 6,036,189 | A | 3/2000 | Gomez et al. | 273/118 R |
| 6,047,962 | A * | 4/2000 | Popadiuk | 273/119 A |
| 6,061,042 | A | 5/2000 | Takahashi et al. | |
| 6,135,884 | A | 10/2000 | Hedrick et al. | 463/20 |
| 6,151,093 | A | 11/2000 | Takahashi et al. | |
| 6,315,666 | B1 | 11/2001 | Mastera et al. | 463/31 |
| 6,320,571 | B1 | 11/2001 | Takahashi et al. | |
| 6,368,216 | B1 | 4/2002 | Hedrick et al. | 463/20 |
| 6,383,076 | B1 | 5/2002 | Tiekeken | 463/40 |
| 6,450,884 | B1 | 9/2002 | Seelig et al. | 463/17 |
| 6,464,581 | B1 | 10/2002 | Yoseloff et al. | 463/20 |
| 6,517,433 | B2 | 2/2003 | Loose et al. | 463/20 |
| 6,517,437 | B1 | 2/2003 | Wells et al. | 463/30 |
| 2002/0077172 | A1 | 6/2002 | Uchiyama et al. | 463/20 |
| 2003/0069064 | A1 | 4/2003 | Ainsworth | 463/20 |
| 2003/0073484 | A1 | 4/2003 | Jo | 463/20 |

FOREIGN PATENT DOCUMENTS

| | | |
|---|---|---|
| JP | 02-057278 | 2/1990 |
| JP | 02-064988 | 3/1990 |
| JP | 04-357106 | 12/1992 |
| JP | 06-109013 | 4/1994 |
| JP | 07-036120 | 1/1995 |
| JP | 07-136345 | 5/1995 |
| JP | 07-323126 | 12/1995 |
| JP | 08-309023 | 11/1996 |
| JP | 08.323037 | 12/1996 |
| JP | 08-323037 | 12/1996 |
| JP | 09-159236 | 6/1997 |
| JP | 11-114221 | 4/1999 |
| JP | 11-151352 | 6/1999 |
| JP | 02-182150 | 6/2002 |

OTHER PUBLICATIONS

U.S. patent appl. No. 08/827,798 of Takiguchi et al., filed Apr. 11, 1997.

* cited by examiner

*Primary Examiner*—Jessica Harrison
*Assistant Examiner*—Alex P. R. P. Rada, II
(74) *Attorney, Agent, or Firm*—Welsh & Katz, Ltd.

(57) ABSTRACT

An object of the invention is to provide a display device which can provide both a slot game having realism and a colorful and rich display by mechanical reels.

A superimposed display device according to the present invention comprises an image display section disposed in a position to face a player side, mechanical reels disposed on a line which intersects another line connecting the image display section and the player side, a lighting section for illuminating the mechanical reels, a half mirror which is inclined in a plane including a region where the above lines intersect, in which virtual images of designs on peripheries of the mechanical reels are shown in the same plane to a player, and images are shown by superimposing in the entire region or a part of the region of the virtual image display region.

6 Claims, 6 Drawing Sheets

VIRTUAL IMAGE AND REAL IMAGE SUPERIMPOSED DISPLAY DEVICE, IMAGE DISPLAY CONTROL METHOD, AND IMAGE DISPLAY CONTROL PROGRAM

BACKGROUND OF THE INVENTION

1. Field of the Invention

The present invention relates to a display control device which displays virtual images which are shown with mechanical reels reflected on a half mirror and an image which is output from an image display device placed in a position to directly face the player in a superimposed state via the half mirror, a display control method, and a display control program.

2. Description of the Related Art

As a game machine using an image display device employing a virtual image, there is disclosed an amusement machine in Japanese Patent Application Laid-Open No. 11-104311.

A variable display device is comprised of spinning drums which have special designs formed on their peripheries, drum lamps which can irradiate light to the special designs of the spinning drums, a half mirror which allows visible permeation of the special designs by lighting from the drum lamps, and a projection display mechanism which can project a projection image to show it on the half mirror. The projection display mechanism projects character designs to show them as projection images on the half mirror.

By configuring as described above, a mechanical variable display device which can display the character designs in addition to the display of the special designs is provided, and ornamental visual effects are obtained.

As described above, according to the amusement machine disclosed in Japanese Patent Application Laid-Open No. 11-104311, the player visually recognizes the special designs of the spinning drums through the half mirror, and the projection image is projected onto the half mirror to superimpose on the special designs of the spinning drums. But, the amusement machine becomes bulky and has a large depth because the spinning drums are located to directly face the player.

The above projection image is just a character design on a previously provided film and low in flexibility and lacks in adaptability though it is a motion picture.

SUMMARY OF THE INVENTION

In view of the circumstances described above, it is an object of the invention to provide an image display control device, which has mechanical reels disposed in a position to intersect a line between the player and an image display section to reduce a depth size and to enable expressions such as a change in peripheral designs, a change in shape, blazing up, luminescence and others which cannot be expressed by the mechanical reels alone, enables both a slot game having realism and a colorful and rich display, and enables to make a superimposed display of virtual images rich in entertainment and real images, an image display control method, and an image display control program.

The virtual image and real image superimposed display device according to claim 1 of the present invention is a virtual and real image superimposed display device, which is a display device for a game machine, having an image display section which is connected to a display control section and disposed in a position to face a player side, mechanical reels disposed on a second virtual line which intersects a first virtual line connecting the image display section and the player side, and a lighting section disposed in the vicinity of the mechanical reels for illuminating the mechanical reels; and a half mirror which is disposed in a plane in front of the image display section and including a region where the first and second virtual lines intersect to incline toward the image display section or the player side, thereby showing images, which are displayed by the image display section and permeated through the half mirror, and virtual images of designs drawn on peripheries of the mechanical reels and reflected by the half mirror to a player in the same plane, wherein: the display control section is configured to make appropriate image display control of still pictures or motion pictures to be superimposed in an entire region or a part of the region of the designs which are visually recognized at least on the half mirror.

By configuring as described above, it is possible to reduce a depth of the image display device.

It is also possible to realize both a game having realism and a colorful and rich display which are considered difficult to realize by the structure of mechanical reels only.

The image display control method according to claim 2 of the present invention is an image display control method for a game machine which comprises: an image display section which is connected to a display control section and positioned to face a player side; mechanical reels which are disposed on a second virtual line which intersects a first virtual line connecting the image display section and the player side; a lighting section which is disposed in the vicinity of the mechanical reels to illuminate the mechanical reels; and a half mirror which is disposed in a plane in front of the image display section and including a region where the first and second virtual lines intersect to incline toward the image display section or the player side, wherein: it is controlled by a computer to show still pictures or motion pictures on the image display section by superimposing on an entire region or a part of the region of virtual images of the designs drawn on the peripheries of the mechanical reels, which are reflected by the half mirror and visually recognized.

By configuring as described above, the details of the still pictures or the motion pictures to be superimposed can be expressed as the game having realism and the colorful and rich images, which are hardly realized by the representation by means of the mechanical reels only, by flexibly controlling a change in peripheral designs, a change in shape, blazing up, luminescence and other images on the peripheries of the mechanical reels.

The image display control program according to claim 3 of the present invention is an image display control program for a game machine which comprises: an image display section which is connected to a display control section and positioned to face a player side; mechanical reels which are disposed on a second virtual line which intersects a first virtual line connecting the image display section and the player side; a lighting section which is disposed in the vicinity of the mechanical reels to illuminate the mechanical reels; and a half mirror which is disposed in a plane in front of the image display section and including a region where the first and second virtual lines intersect to incline toward the image display section or the player side, wherein: the program is executed by a computer so that still pictures or motion pictures are shown on the image display section by superimposing on an entire region or a part of the region of virtual images of designs drawn on peripheries of the mechanical reels, which are reflected by the half mirror and visually recognized.

By configuring as described above, the details of the still pictures or motion pictures to be superimposed can achieve a game display rich in entertainment by realizing both a slot game having realism and a colorful and rich display, which are considered difficult to realize by the representation by means of the mechanical reels only, by using a change in peripheral designs, a change in shape, blazing up, luminescence and other images on the peripheries of the mechanical reels.

DESCRIPTION OF THE PREFERRED EMBODIMENTS

Details of the present invention will be described with reference to the accompanying drawings showing an embodiment of the invention.

Figure 1:
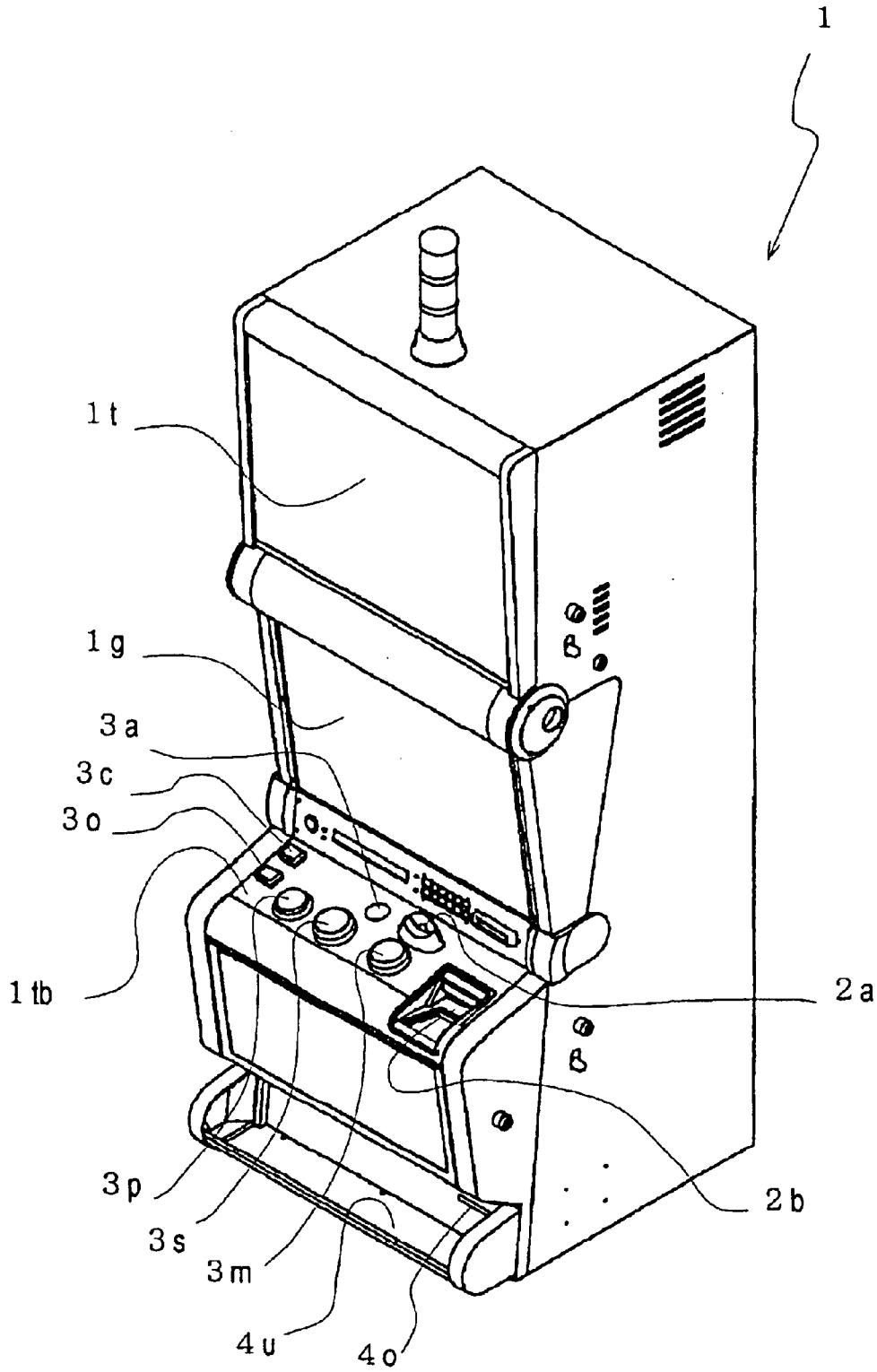
FIG. 1 is a perspective diagram showing a slot game machine according to the present invention.
Figure 2:
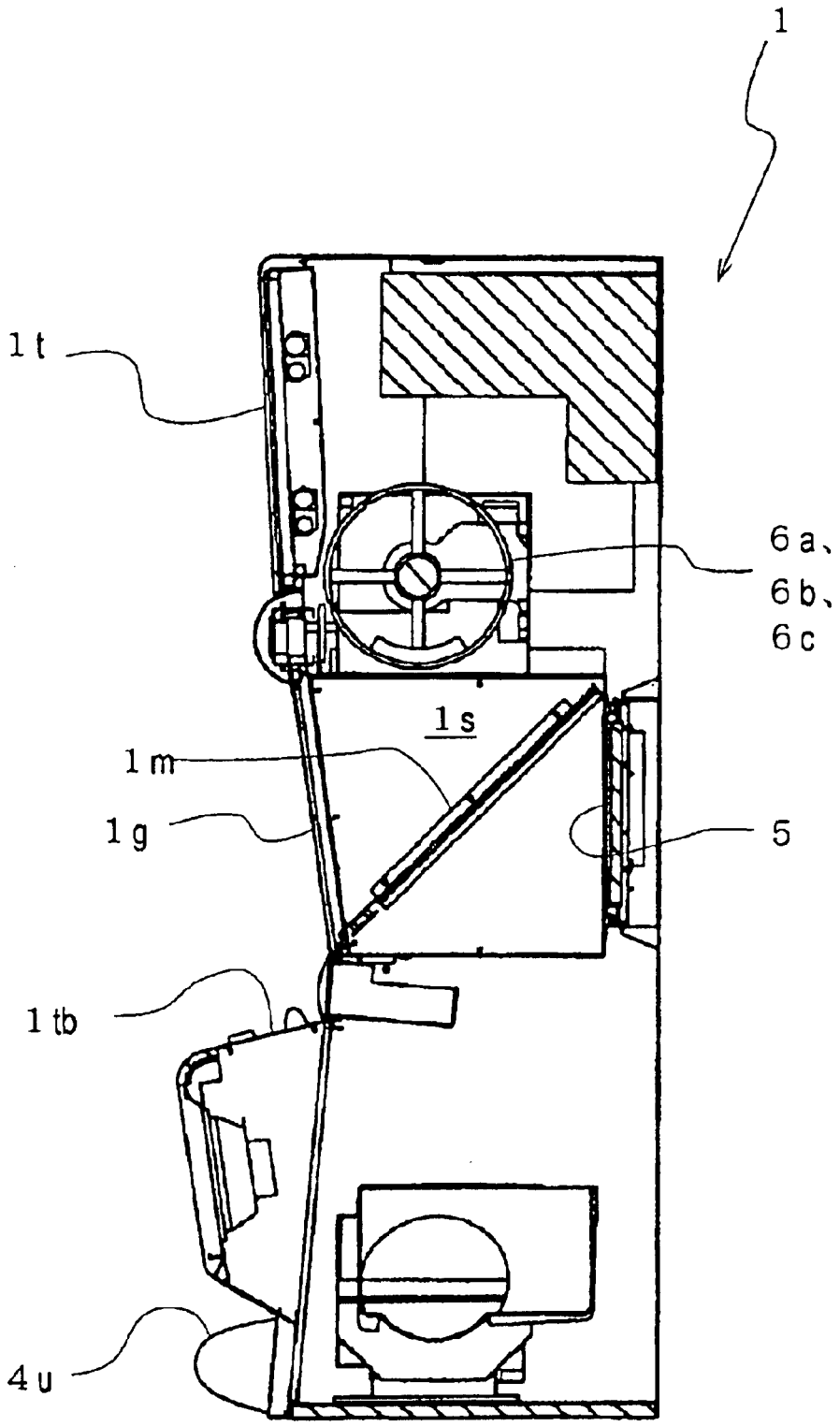
FIG. 2 is a vertical sectional diagram showing the slot game machine according to the invention.

FIG. 1 is a perspective diagram of the appearance of a gaming slot machine 1 to which the present invention pertains, and FIG. 2 is a vertical sectional diagram viewed from one side of the slot game machine.

As shown in FIG. 1 and FIG. 2, the slot game machine 1 has a liquid crystal display panel (LCD) 5 which is erected in a position to face a player p within a protection glass 1*g* through which the player p sees, a half mirror 1*m* which is disposed in front of the liquid crystal display panel 5 to forwardly lean toward the player, and one set of mechanical reels 6*a*, 6*b*, 6*c* which are disposed in a top box 1*t* above the half mirror 1*m*.

As shown in FIG. 1 and FIG. 2, a control table 1*tb* is protruded from the front of the slot game machine 1 to incline forward so that the player p can control with ease, and the transparent protection glass 1*g* is mounted above the control table 1*tb* to allow the player p to see a game space 1*s* in the slot game machine 1 and also to protect it.

Figure 3:
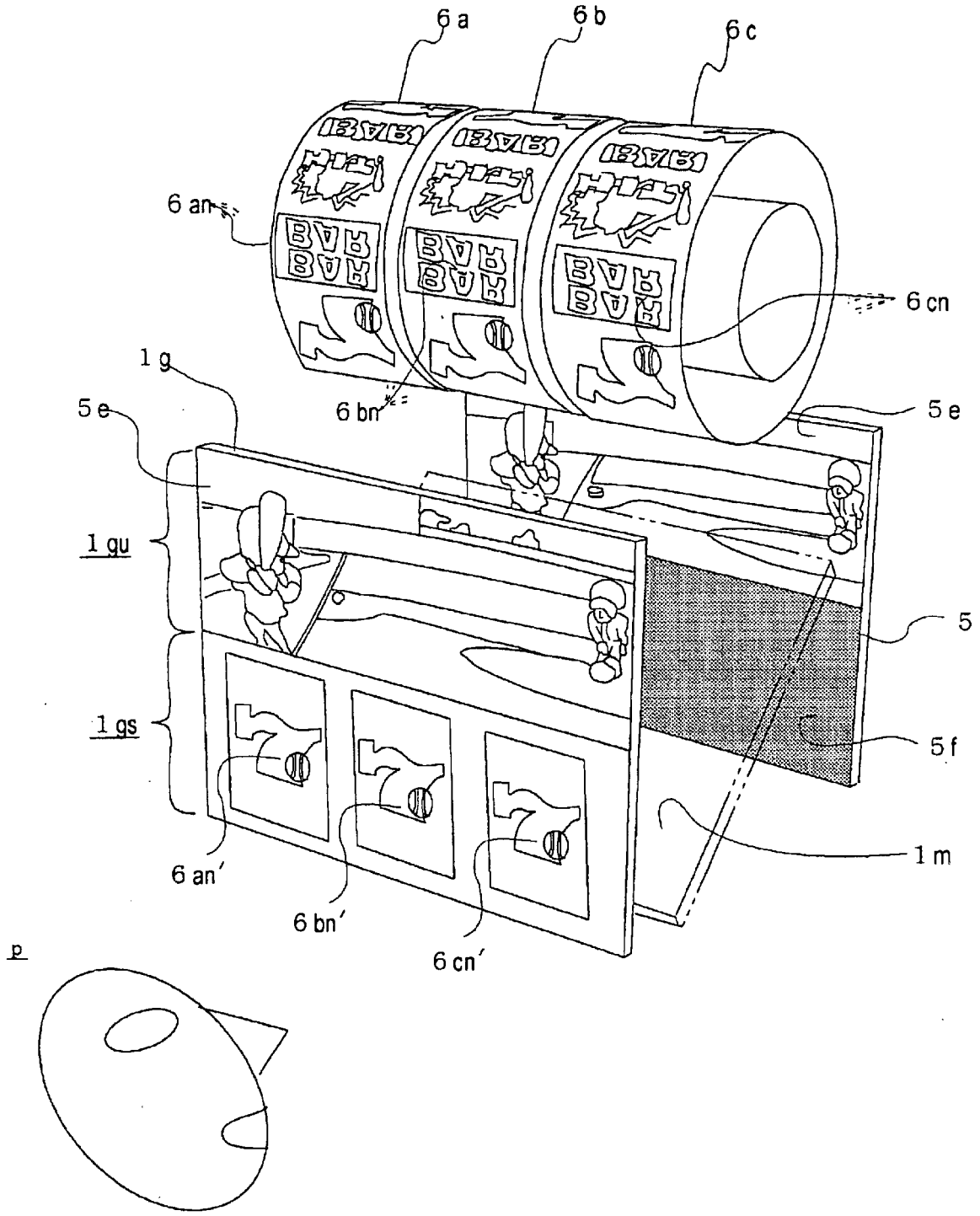
FIG. 3 is a model chart showing a display example of an ordinary display mode according to the invention.

As shown in FIG. 2 and FIG. 3, in the game space 1*s* which is protected by the protection glass 1*g*, the liquid crystal display panel 5 which is a flat panel display is erected to display game images in a position to directly face the player, and the half mirror 1*m* is also disposed to downwardly incline at an angle of 45 degrees toward the player p.

The half mirror 1*m* has an inclination angle of 45 degrees, but it is to be understood that it may be disposed at any angle other than the inclination angle of 45 degrees if the designs on the peripheries of the mechanical reels 6*a*, 6*b*, 6*c* are reflected on the half mirror 1*m* and visible as virtual images 6*an*', 6*bn*', 6*cn*' from the player.

Furthermore, the liquid crystal display panel 5 is used as an image display device for showing the game images, but it is to be understood that another image display device such as a plasma display panel may be used instead of the liquid crystal display panel 5.

As shown in FIG. 2, the mechanical reels 6*a*, 6*b*, 6*c* are housed in the top box 1*t* above the half mirror 1*m*, and as shown in FIG. 3, the player p sees the virtual images 6*an*', . . . , 6*bn*', . . . , 6*cn*', . . . , which are reflections of designs 6*an*, . . . , 6*bn*, . . . , 6*cn*, . . . on the peripheries of the mechanical reels 6*a*, 6*b*, 6*c*, in a lower half region 1*gs* for the game display inside the protection glass 1*g*.

The mechanical reels 6*a*, 6*b*, 6*c* are directly driven to rotate separately by stepping motors M1, M2, M3 (FIG. 4) which are driven to rotate at an angle determined by digital control.

Here, it is to be understood that a transmission mechanism appropriately employing a transmission belt, a gear mechanism or the like may be adopted for the spinning drive of the mechanical reels 6*a*, 6*b*, 6*c*.

To stop each of the mechanical reels 6*a*, 6*b*, 6*c* at design positions corresponding to payoff points which are determined by internal lottery, a position sensor I (22*a*), a position sensor II (22*b*) and a position sensor III (22*c*) (see FIG. 4) are applied to the mechanical reels 6*a*, 6*b*, 6*c* respectively to control their positions.

As the position sensor I (22*a*), the position sensor II (22*b*) and the position sensor III (22*c*), an optical sensor such as a photodiode, phototransistor or the like may be selected appropriately.

And, a reel lamp I (6*al*), a reel lamp II (6*bl*) and a reel lamp III (6*cl*) which illuminate the designs 6*an*, . . . , 6*bn*, . . . , 6*cn*, . . . on the peripheries of the mechanical reels 6*a*, 6*b*, 6*c* to show them conspicuously are disposed within the mechanical reels 6*a*, 6*b*, 6*c*.

Here, the reel lamp I (6*al*), the reel lamp II (6*bl*) and the reel lamp III (6*cl*) can project the designs 6*an*, . . . , 6*bn*, . . . , 6*cn*, . . . on the peripheries of the mechanical reels 6*a*, 6*b*, 6*c* onto the half mirror 1*m* to show as the virtual images 6*an*', 6*bn*', 6*cn*'.

In this embodiment, the reel lamp I (6*al*), the reel lamp II (6*bl*) and the reel lamp III (6*cl*) are disposed within the mechanical reels 6*a*, 6*b*, 6*c* but may be disposed outside of the mechanical reels 6*a*, 6*b*, 6*c*.

Furthermore, it is seen in FIG. 1 that a coin insertion slot 2*a* through which a coin or coins are inserted by the player p to bet on the slot game and a paper money insertion slot 2*b* through which paper money is inserted to bet on the slot game are disposed on the control table 1*tb*.

There are also disposed on the control table 1*tb* a unit bet button 3*p* which is used to bet one unit every time it is pushed for a unit bet, e.g., five cents, 25 cents or one dollar, for a single game particularly determined for the slot game machine 1, a maximum bet/play button 3*m* which is used to bet a maximum bet every time it is pushed, e.g., a three unit bet or a five unit bet, particularly determined for the slot game machine 1 and also to start spinning the mechanical reels 6*a*, 6*b*, 6*c*, and a bet display 3 a for showing what units are bet.

There are also disposed on the control table 1*tb* a play button 3*s* for starting to spin the mechanical reels 6*a*, 6*b*, 6*c* and a cash out button 3*o* for dispensing cash in total of the balance between the bet that the player p has inserted through the coin insertion port 2*a* or the paper money insertion port 2*b* and the total amount used for the game and the won payoff for the slot game.

And, a ticket outlet port 4*o* is disposed on the wall below the control table 1*tb* of the slot game machine 1, and it may dispense a token ticket for the payoff instead of cash.

Furthermore, a payoff return port 4*u* is disposed to protrude from the wall below the ticket outlet port 4*o*, where the token tickets discharged from the ticket outlet port 4*o* or coins to be dispensed from a hopper 27 when the game is over and settled in cash are accumulated.

Then, a structure of the control section of the slot game machine 1 will be described.

Figure 4:
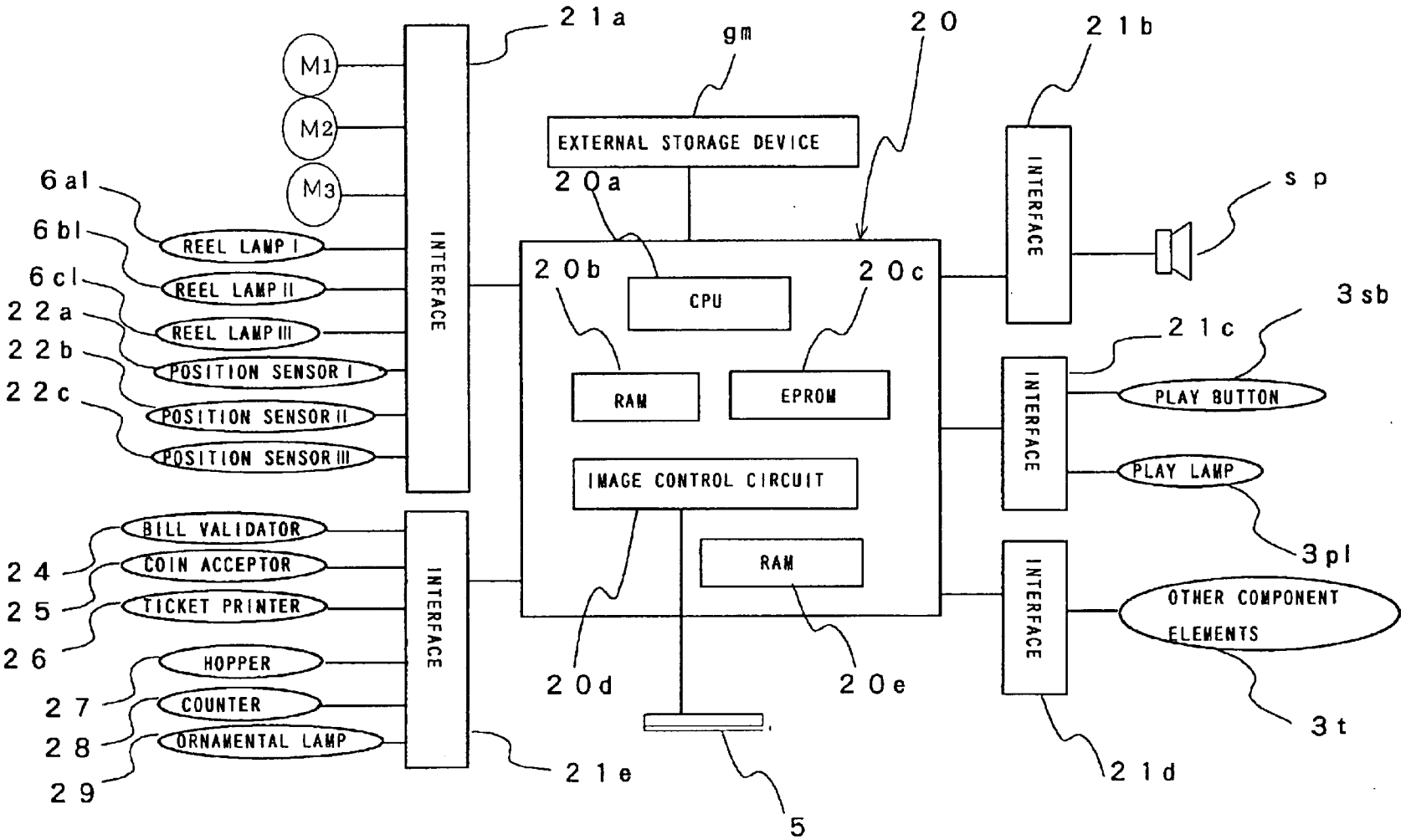
FIG. 4 is a block diagram showing a control structure of the slot game machine according to the invention.

As shown in FIG. 4, a control section 20 for controlling the slot game machine 1 is comprised of a CPU (central processing unit) 20*a* which is the core of the control, an EPROM (erasable programmable read-only memory) 20*c* on which a control procedure is contained in advance, a RAM (random access memory) 20*b* for storing work data, an image control circuit 20*d* which controls image data to convert into and output an analog image signal, and a RAM 20*e* as a graphic memory.

A series of operation of the slot game machine 1 is performed by the CPU 20*a* as the control program, control data and tables needed for processing which are stored in the EPROM 20*c* are loaded into the RAM 20*b* and executed.

Processing by the aforementioned control program includes reel control processing for driving and stopping the stepping motors M1, M2, M3 which drive to spin the mechanical reels 6*a*, 6*b*, 6*c* respectively, game image output control processing, synchronization control processing of the reel control processing and the image output control processing, detection processing of an input operation by a player, computing processing for judgment of realization of winning hands, the number of won games and a total of credits, computing processing of the balance of bets, game sound output processing, etc.

The RAM 20*b* temporarily stores variable data needed for processing when the above control processing is executed.

The tables stored in the EPROM 20*c* include a realized winning hand judgment table, a stop control table, a synthesized display information table, etc.

First, the stop control table will be described.

The designs 6*an*, . . . , 6*bn*, . . . , 6*c*, . . . on the respective peripheries of the mechanical reels 6*a*, 6*b*, 6*c* are defined as absolute positions on the reels coded (hereinafter called as the design position codes) as integer values 1 to n in the disposed order.

Among all the designs on the peripheries of the mechanical reels, all types excluding the overlapped designs are coded as the integer values in increasing order from 1 (hereinafter called as "design codes").

The above design position codes are used as indexes, and the corresponding design codes associated with them are the contents of data in the stop control table.

Using the above stop control table, it is possible to obtain a relation of the relative positions from a reference design to a target stop design and to calculate a spin angle of the reel.

Then, the realized winning hand judgment table will be described.

The winning hand realization, which is decided by a combination of the designs shown on the respective mechanical reels 6*a*, 6*b*, 6*c* whose spinning are stopped, are decided according to random numbers generated at a prescribed probability among random numbers generated by a random number generator.

Therefore, the respective realized winning hands are coded (hereinafter called as "realized winning hand code") as the integer values in increasing order from 1, and a combination of designs corresponding to the respective realized winning hand codes, the amount of payoff for the realized winning hands and the like are stored in a realized winning hand judgment table.

Here, a data form of the above combination of stop designs is stored as a combination of design codes to enable a linkage with the above stop control table.

Then, the synthesized display information table will be described.

For the superimposed display of the stop designs 6*an*, 6*bn*, 6*cn* of the mechanical reels 6*a*, 6*b*, 6*c* and images, synchronization control processing is needed between the reel control processing and the image display control processing.

Therefore, information related to a starting time of representation of the image control and the image data is defined for each of the above realized winning hand codes in the synthesized display information table.

In the definition information on the representation of the images, information on a remaining spin angle of each reel and file information on image data and graphic patterns needed for preparation of the image data for superimposing are stored as a condition for outputting image data for superimposing.

Information on the remaining spin angle of each reel is stored as a value converted into an output frequency of a pulse signal needed for the spin control by the stepping motor.

And, the RAM 20*b* is provided with a memory region needed for executing the control processing and temporarily stores variable data being processed, or the like.

Specifically, it temporarily stores the number of coins inserted by the player p, a total of credits, the number of gained coins, realized winning hands, states of the mechanical reels, stop design codes and other data needed for performing the game.

The control section 20 is connected to the stepping motor M1, the stepping motor M2 and the stepping motor M3 which drive the mechanical reels 6*a*, 6*b*, 6*c* respectively, the reel lamp I (6*al*), the reel lamp II (6*bl*) and the reel lamp III (6*cl*) in the respective mechanical reels 6*a*, 6*b*, 6*c*, and the position sensors 22*a*, 22*b*, 22*c* which detect the spin positions of the mechanical reels 6*a*, 6*b*, 6*c* through an interface 21*a* including a motor drive circuit, a sensor circuit and the like.

Furthermore, the control section 20 is connected to a loud speaker sp, which outputs game effect sounds, through an interface 21*b*.

The control section 20 is also connected through an interface 21*e* such as a chattering prevention circuit to a bill validator 24 for reading paper money inserted through the paper money insertion slot 2*b*, a coin acceptor 25 for checking whether coins inserted through the coin insertion port 2*a* are authentic or not, a ticket printer 26 for printing token tickets, a hopper 27 for dispensing coins at the end of a game for payoff in cash, a counter 28 for counting the amount inserted into the slot game machine 1, the payoff amount and the like for the game machine administrator, ornamental lamps 29 for providing game effect illumination, and the like.

And, the image control circuit 20*d* is connected to the liquid crystal display panel 5 to receive a production signal from the CPU 20*a*, uses the RAM 20*e* as a graphic memory to perform drawing processing, and performs a digital-to-analog conversion to display images on the liquid crystal display panel 5.

Furthermore, other component elements 3*t* are connected to the control section 20 through an interface 21*d*.

An external storage device gm such as a CD-ROM (compact disk read only memory) is connected to the control section 20 and stores image data, sound data and the like for the game.

Then, an ordinary display mode (FIG. 3) and a superimposed display mode (FIG. 5) will be described respectively in connection with the game display by the slot game machine 1.

First, the ordinary display mode for the game display shows an image 5*e* in the upper half region of the liquid crystal display panel 5 and a dark color 5*f* in the whole lower half region.

The peripheral designs 6*an*, 6*bn*, 6*cn* of the mechanical reels 6*a*, 6*b*, 6*c* illuminated by the reel lamp I (6*al*), the reel lamp II (6*bl*) and the reel lamp III (6*cl*) in the mechanical reels 6*a*, 6*b*, 6*c* are reflected on the half mirror 1*m* and displayed as the virtual images 6*an*', 6*bn*', 6*cn*' in a game display region 1*gs* corresponding to the lower half region 5*f* displayed in a dark color on the liquid crystal display panel 5.

Figure 5:
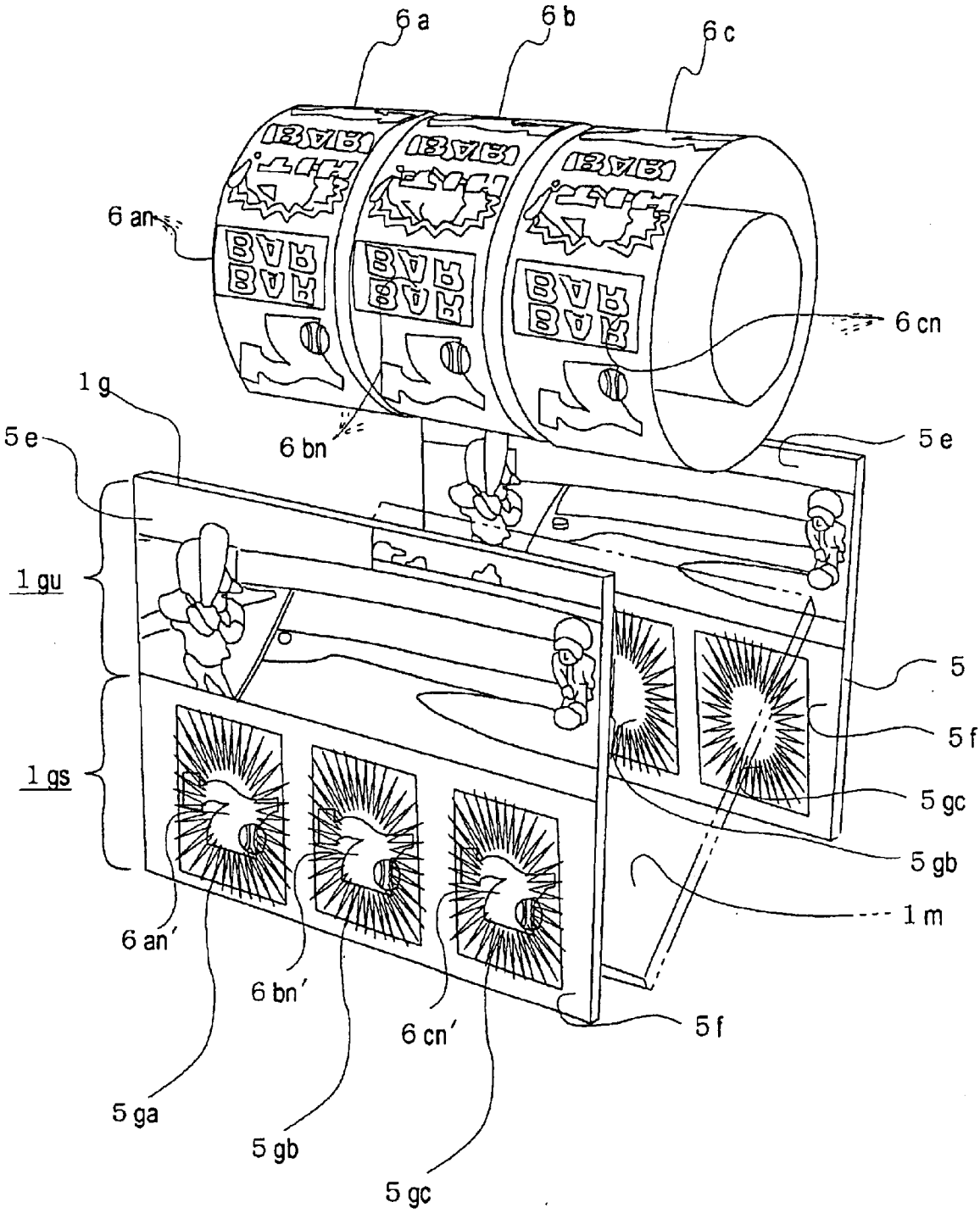
FIG. 5 is a model chart showing a display example of a superimposed display mode according to the invention.

Meanwhile, the superimposed display mode of the game display shows the image 5*e* in the upper half region of the liquid crystal display panel 5 as shown in FIG. 5, and shows in the display region 1*gs* corresponding to the lower half region of the liquid crystal display panel 5 the virtual images 6*an*', 6*bn*', 6*cn*' of the designs 6*an*, 6*bn*, 6*cn* on the peripheries of the mechanical reels 6*a*, 6*b*, 6*c* illuminated by the reel lamp I (6*al*), the reel lamp II (6*bl*) and the reel lamp III (6*cl*) in the mechanical reels 6*a*, 6*b*, 6*c*.

And, images 5*ga*, 5*gb*, 5*gc* are shown in certain areas of the lower half region 5*f* of the liquid crystal display panel 5 in such a way to overlap the virtual images 6*an*', 6*bn*', 6*cn*' after permeating through the half mirror.

Then, the virtual images 6*an*', 6*bn*' 6*cn*' of the designs 6*an*, 6*bn*, 6*cn* on the peripheries of the mechanical reels 6*a*, 6*b*, 6*c* are superimposed on the images 5*ga*, 5*gb*, 5*gc* of the liquid crystal display panel 5 and shown in the lower half region 1*gs* of the game display.

Then, a processing procedure of the image display control program in the aforementioned superimposed display mode (FIG. 5) will be described with reference to the flow chart shown in FIG. 6.

In the following description, the respective mechanical reels 6*a*, 6*b*, 6*c* will be called as a first stop reel, a second stop reel and a third stop reel in stopping order of them.

Therefore, when the stopping order of the reels is changed, the corresponding relation of the mechanical reels 6*a*, 6*b*, 6*c* is changed.

FIG. 5 is a diagram showing as the superimposed display mode the representation display of a "Winning notification" by the mechanical reels which illuminate at the same time when the third stop reel stops.

First, the superimposed display control processing obtains the design position codes which have the stop designs 6*an*', 6*bn*', 6*cn*' on the mechanical reels 6*a*, 6*b*, 6*c* immediately before the start of the game temporarily stored in the memory (hereinafter called as "work area") which is secured in the RAM 20*b*.

Subsequently, in view of the design position codes and the respective design position codes of realized winning hands decided by the internal lottery processing, the spin angles of the respective mechanical reels 6*a*, 6*b*, 6*c* are calculated according to the stop control table.

And, the spin angles are converted into the number of times of output processing (hereinafter called as the "number of pulse sending") of a pulse signal needed for driving of the stepping motors M1, M2, M3 in the respective mechanical reels 6*a*, 6*b*, 6*c* and temporarily stored in the work area. (Step 1)

Then, data about the realized winning hand code is obtained from the synthesized display information table in the work area.

In items in the obtained data, file information about picture image data for representation and the remaining number of pulse sending when its representation display is started are determined for each reel, and the obtained data is temporarily stored in the work area. (Step 2)

Then, among the number of pulse sending of the respective reels obtained in the (step 1), the maximum value is determined as the number of executions of the loop processing.

Here, the number of pulse sending of each reel is subtracted by 1 until it becomes zero every time a single loop processing is executed, and stored as a variable value in the work area until the loop processing is completed.

As a continuation condition of the loop processing, a series of processing from (step 3) to (step 4) is repeated when all the numbers of remaining pulse sending of the respective reels do not become zero. (Step 3)

Control data is created to generate a pulse signal one time for the stepping motor for the mechanical reel having the number of remaining pulse sending of other than zero and output to the interface 21*a*. *(Step 3-1)*

Subsequently, the determined value to start the representation display of the respective mechanical reels obtained in the (step 1) and the number of remaining pulse sending of the respective mechanical reels recalculated in the (step 3) are compared. If the values agree for at least one mechanical reel, the processing of (step 4-1) is executed, but if not, the processing of the (step 3) is resumed. (Step 4)

Based on information about image date for superimposed display obtained in the (step 1), image data on anime patterns recorded in the external storage device 20*gm* needed for image display is read into the work area, a frame picture is created for superimposed display by drawing processing, data is output to a displaying frame buffer in the ROM 20*e* and a demand for display processing is also made to the image control circuit 20*d*. (Step 4-1)

By performing the above processing step, synchronization control becomes possible between the superimposed image display processing for representation and the stop control processing of the mechanical reels in a single game.

And, by appropriately changing the prescribed values of the image display starting time which are values prescribed for the respective mechanical reels 6*a*, 6*b*, 6*c* in the synthesized display information table in the aforementioned processing step, it is possible to make synchronization control in the superimposed display processing of various patterns according to the order of stopping the mechanical reels 6*a*, 6*b*, 6*c*, and a combination of activation states such as spinning, stop, or the like.

For example, FIG. 5 shows the representation that all reels are illuminated by making the superimposed display of a "Winning notification" at the same time when the third stop reel is stopped at the establishment of extra points.

When it is determined that the number of remaining pulse sending from the start of the reels to the stop of the first stop reel to the third stop reel for the realized winning hand design codes is [5, 10, 15] respectively and the reels for superimposed display are all reels, the synthesized display information table is determined to have the following contents.

The set value about the superimposed image display start time in the synthesized display information table is agreed with the last sending time of a pulse signal of the third stop reel which stopped last. Therefore, the number of remaining pulse sending of the first stop reel, the second stop reel and the third stop reel is determined as [0, 0, 1], and an image file name such as a graphic pattern for representation of light of all reels, or the like is determined in information about the image file for representation.

Then, it becomes (YES) in the condition judging processing of the above (step 4), the display processing of a superimposed image of the (step 4-1) is performed, and the superimposed display for the "Winning notification" in agreement with the stop timing of the third stop reel can be made.

As another example, a method of setting data in the synthesized display information data, when a combination of stop designs excluding the third stop reel, which is still spinning when the second stop reel has stopped, partly agrees with a row of realized winning hand and the representation of a "Reach notification" is processed, will be described.

Here, the above "Reach" means a state that when the spinning reels are stopped sequentially but one reel remains still spinning, the row of designs of the stopped reels completely agrees with a row of designs defined as realized winning hands.

First, the number of remaining pulse sending from the first stop reel to the third stop reel from the start of the reel of realized winning hands to the stop of all reels is determined as [5, 10, 15], and the subject reels for the superimposed display are determined as the first stop reel and the second stop reel.

Then, the processing to output a pulse signal to the stepping motors for the respective reels must be made 10 times from the start of the operation of all reels to the stop of the second stop reel when the reach is determined.

Therefore, when it is made possible to display on the liquid crystal display panel 5 substantially at the same time when output of the superimposed image is demanded, the predetermined values to start the display processing of the superimposed image are set to [0, 0, 5] in order of a combination of the number of remaining pulse sending of the first stop reel, the second stop reel and the third stop reel.

Information about the image files to be superimposed on the subject reels, the first stop reel and the second stop reel, is set to the image information in the synthesized display information table corresponding to the realized winning hand code of the "Reach notification".

And, for the same realized winning hand code in the synthesized display information table, when representation information is determined to be two sets or more of a combination of the remaining number of pulse sending of the first stop reel, the second stop reel and the third stop reel, plural times of superimposed display processing can also be made between the start of the reels and the stop of all the reels.

Furthermore, there are three reels in total in this embodiment, but it is to be understood that if there are four or more reels, the processing can be made by expanding data items for the number of reels to be added for each table and setting definition information.

The synchronized control of the mechanical reels and the images is not limited to the aforementioned method which uses the remaining number of pulse signal sending needed for the spin angle before stopping the reels, and it can also be achieved by a method using timer control or the like.

Figure 6:
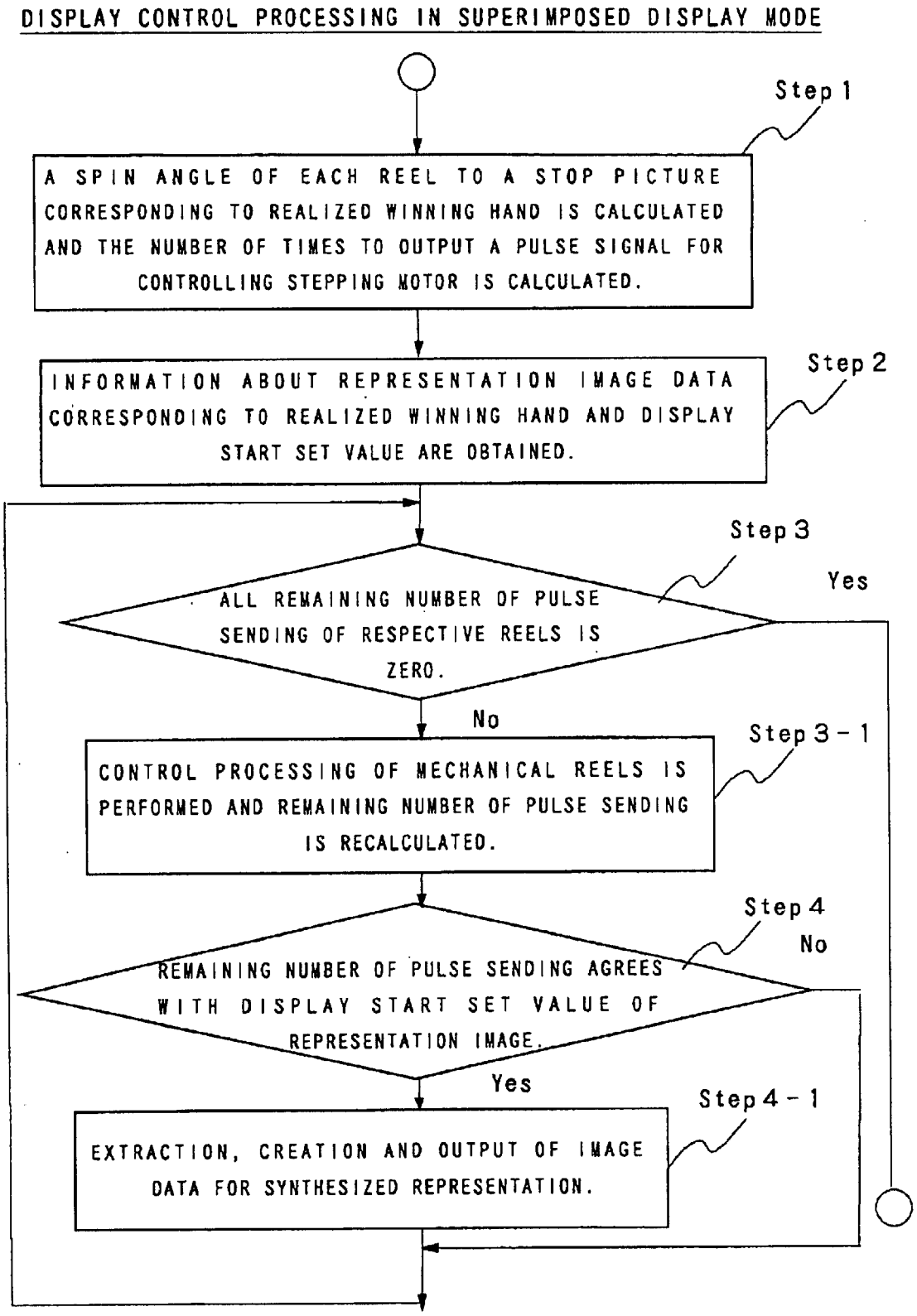
FIG. 6 is a flow chart showing an image display control procedure in the superimposed display mode according to the invention.

The mechanical reel and image superimposed display is not limited to the duration of a single game (from the start to the stop of all reels) as shown in the flow chart of FIG. 6. It is to be understood that the representation can be made to urge the player to play the game during standby before the start of the game, the representation can be made to sequentially superimpose on the respective mechanical reels when the player controls the buttons, e.g., every time the unit bet button is pushed, the representation can be made to make superimposed display on all the reels when the maximum bet/play button 3*m* is pushed, and the like.

Then, a variable structure example other than this embodiment of the superimposed display device according to the invention will be described.

As to the arrangement of the game display region, the designs 6*an*, 6*bn*, 6*cn* on the mechanical reels 6*a*, 6*b*, 6*c* may be shown as the virtual images 6*an*', 6*bn*', 6*cn*' on the upper half region 1*gu* of the game display by means of the half mirror 1*m*, and the image 5*e* of the liquid crystal display 5 may be shown in the lower half region 1*gs*.

Furthermore, the game display region may be divided into an upper region, a middle region and a bottom region, the designs 6*an*, 6*bn*, 6*cn* on the mechanical reels 6*a*, 6*b*, 6*c* are shown as the virtual images 6*an*', 6*bn*', 6*cn*' in the middle region of the game display by the half mirror 1*m*, and the image of the liquid crystal display 5 may be appropriately arranged either in the upper region or in the bottom region.

For the arrangement position of the mechanical reels 6*a*, 6*b*, 6*c*, the half mirror 1*m* may be disposed to incline downwardly at an angle of 45 degrees from the side of a player toward the back of the housing, and the mechanical reels 6*a*, 6*b*, 6*c* may be disposed below the half mirror.

But, the designs 6*an*, 6*bn*, 6*cn* of the mechanical reels 6*a*, 6*b*, 6*c* are arranged in such a way that their front and rear and right and left are reversed from those of this embodiment.

According to the above configuration, a depth size, which cannot be reduced for a game machine which is configured so that the mechanical reels are directly seen by a player, can be reduced. And, a slot game having realism and a colorful and rich display can be realized, and an superimposed display of virtual and real images rich in entertainment can be realized.

As described above, the slot game machine was described in the above embodiments, but it is to be understood that the virtual image and real image superimposed display device according to the present invention can be effectively applied to a game machine having different mechanical reels.

What is claimed is:

1. A virtual and real image superimposed display device, which is a display device for a game machine, having:

an image display section which is connected to a display control section and disposed in a position to face a player side, mechanical reels disposed on a second virtual line which intersects a first virtual line connecting the image display section and the player side, a lighting section disposed in the vicinity of the mechanical reels for illuminating the mechanical reels, a plurality of position sensors for individually detecting spin positions of the plurality of mechanical reels; and a half mirror which is disposed in a plane in front of the image display section and including a region where the first and second virtual lines intersect to incline toward the image display section side or the player side, thereby showing representation images, which are displayed by the image display section and permeated through the half mirror, and virtual images of designs drawn on peripheries of the mechanical reels and reflected by the half mirror to a player in the same plane, wherein:

the display control section generates the representation images based on information on remaining spin angle of each mechanical reel calculated on the basis of detected outputs of the plurality of positional sensors and displays the generated representation images on the image display section, when performing the stop control of each mechanical reel by a combination of stopping designs determined by an internal lottery processing at the time of starting a game, and the display control section is configured to make appropriate image display control of still pictures or motion pictures to be superimposed in an entire region or a part of the region of the designs which are visually recognized on the half mirror.

2. A virtual and real image superimposed display device according to claim 1, wherein:

spin of each mechanical reel is controlled by a stepping motor, the information on remaining spin angles is a value converted into the number of outputs of residual pulse signals issued to drive the stepping motor, and the display control section generates and displays the representation images on the image display section when the number of outputs of residual pulse signals that control the remaining spin angle of each mechanical reel coincides with the number of outputs of residual pulse signals indicating the timing of generation and start of output of the representation images set for each combination of the determined stopping designs.

3. An image display control method for a game machine the game machine comprising:

an image display section which is connected to a display control section and positioned to face a player side;

mechanical reels which are disposed on a second virtual line which intersects a first virtual line connecting the image display section and the player side;

a lighting section which is disposed in the vicinity of the mechanical reels to illuminate the mechanical reels;

a half mirror which is disposed in a plane in front of the image display section and including a region where the first and second virtual lines intersect to incline toward the image display section side or the player side;

a plurality of position sensors for individually detecting spin positions of the plurality of mechanical reels; and a storage section for storing beforehand timing of generation and output of representation mages indicated by information on remaining spin angle of each mechanical reel, for each combination of stopping designs determined by an internal lottery processing at the time of starting a game, and wherein the method comprises the steps of:

calculating the information on remaining spin angles until each mechanical reel stops by the combination of the designs corresponding to the stopping designs determined by the internal lottery, based on the detection output of each position sensor, acquiring from the storage section the timing of generation and output of representation images corresponding to the determined stopping designs, and generating and displaying the representation images on the image display section when the calculated information on remaining spin angles coincides with the timing of generation and output of representation images, and showing still pictures or motion pictures on the image display section by superimposing on an entire region or a part of the region of virtual images of the designs drawn on the peripheries of the mechanical reels, which are reflected by the half mirror and visually recognized.

4. The image display control method for a game machine according to claim 3, comprising the further steps of:

controlling the spin of each mechanical reel by a stepping motor, converting the information on remaining spin angles into the number of outputs of pulse signals issued so as to drive the stepping motor, and setting the timing of generation and output of the representation images by the number of outputs of residual pulse signals that control the remaining spin angle of each mechanical reel.

5. An image display control program for a game machine the game machine comprising:

an image display section which is connected to a display control section and positioned to face a player side;

mechanical reels which are disposed on a second virtual line which intersects a first virtual line connecting the image display section and the player side;

a lighting section which is disposed in the vicinity of the mechanical reels to illuminate the mechanical reels;

a half mirror which is disposed in a plane in front of the image display section and including a region where the first and second virtual lines intersect to incline toward the image display section side or the player side;

a plurality of position sensors for individually detecting spin positions of the plurality of mechanical reels; and a storage section for storing beforehand timing of generation and output of representation images for each stopping design determined by an internal lottery processing at the time of starting a game, a computer readable medium comprising the image display control program with computer executable instruction for performing a method comprising the steps of calculating information on a remaining spin angle until each mechanical reel stops by a combination of designs corresponding to the stopping designs determined by the internal lottery, based on the detection output of each positional sensor, acquiring from the storage section the timing of generation and output of the representation images based on the determined stopping designs, and generating and displaying the representation images on the image display section when the calculated information on the remaining spin angle coincides with the acquired timing of generation and output of the representation images, and showing still pictures or motion pictures on the image display section by superimposing on an entire region or a part of the region of virtual images of designs drawn on peripheries of the mechanical reels, which are reflected by the half mirror and visually recognized.

6. The image display control program for a game machine accordingly to claim 5, wherein the method executed by the program includes the further steps of:

controlling the spin of each mechanical reel by a stepping motor, converting the information on remaining spin angles into the number of outputs of pulse signals issued so as to drive the stepping motor, and setting the timing of generation and output of the representation images by the number of outputs of residual pulse signals that control the remaining spin angle of each mechanical reel.

* * * * *